US005829455A

United States Patent [19]

Bauer

[11] Patent Number: 5,829,455

[45] **Date of Patent: *Nov. 3, 1998**

[54] HOLDING STRIP AND CURLING ROD FOR GIVING A PERMANENT WAVE

[76] Inventor: Rudolf Bauer, Königstr. 84, D-7000 Stuttgart 1, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 284,664

[22] PCT Filed: Feb. 9, 1993

[86] PCT No.: PCT/EP93/00313

§ 371 Date: Nov. 3, 1994

§ 102(e) Date: Nov. 3, 1994

[87] PCT Pub. No.: WO93/16614

PCT Pub. Date: Sep. 2, 1993

[30] Foreign Application Priority Data

Feb. 20, 1992 [DE] Germany ..... 42 05 121.5

[51] Int. Cl.[6] ..... A45D 2/00; A45D 6/04

[52] U.S. Cl. ..... 132/222; 132/207; 132/238; 132/268

[58] Field of Search ..... 132/222, 270, 132/271, 203, 210, 108, 110, 122, 148, 237, 238, 239, 240, 241, 243, 268, 207

[56] References Cited

U.S. PATENT DOCUMENTS

| | | | |
|---|---|---|---|
| 741,711 | 10/1903 | Phelan et al. | 132/237 |
| 912,839 | 2/1909 | Goodykoontz | 132/238 |
| 1,994,099 | 3/1935 | Fulton | 132/222 |
| 2,014,283 | 9/1935 | Jackson | 132/239 |
| 2,318,972 | 5/1943 | Simas . | |
| 2,408,657 | 10/1946 | Krasberg | 132/237 |
| 2,586,103 | 2/1952 | Smoth | 132/238 |
| 2,608,977 | 9/1952 | Trippler . | |
| 2,631,593 | 3/1953 | Madore | 132/222 |
| 2,720,207 | 10/1955 | Burtnett . | |
| 2,800,910 | 7/1957 | Seyffarth | 132/222 |
| 2,832,356 | 4/1958 | Reed . | |
| 3,363,634 | 1/1968 | Leclabart | 132/210 |
| 3,520,863 | 7/1970 | Foster et al. | 132/222 |
| 3,543,771 | 12/1970 | Altman | 132/222 |
| 3,548,842 | 12/1970 | McCall | 132/222 |
| 3,692,032 | 9/1972 | Regas | 132/270 |
| 3,960,156 | 6/1976 | Thompson . | |
| 4,196,741 | 4/1980 | Minghenelli | 132/222 |
| 4,206,772 | 6/1980 | Koepp . | |
| 4,316,476 | 2/1982 | Megres | 132/239 |
| 4,638,821 | 1/1987 | Smith | 132/222 |
| 4,884,583 | 12/1989 | Long, Jr. . | |
| 4,989,621 | 2/1991 | Keller | 132/207 |
| 5,090,428 | 2/1992 | Greene et al. | 132/222 |

FOREIGN PATENT DOCUMENTS 2 192 786 1/1988 United Kingdom .

*Primary Examiner*—Todd E. Manahan
*Attorney, Agent, or Firm*—Jones, Tullar & Cooper, P.C.

[57] ABSTRACT

A method of rolling up short strands of hair in the process of giving a permanent wave to a person, a holding strip and a curling device including a curling rod used in the method are related. The holding strip is placed about a strand of hair such that the holding strip forms an extension of the strand of hair. The holding strip with the strand of hair fixed to it is rolled up by the curling device. For this purpose, the curling rod engages the holding strip at an end away from the persons's head and it is rotated and moved toward the head thereby rolling up the holding strip and strand of hair. The holding strip therefore serves as a roller for the strand of hair.

13 Claims, 8 Drawing Sheets

FIG. 2
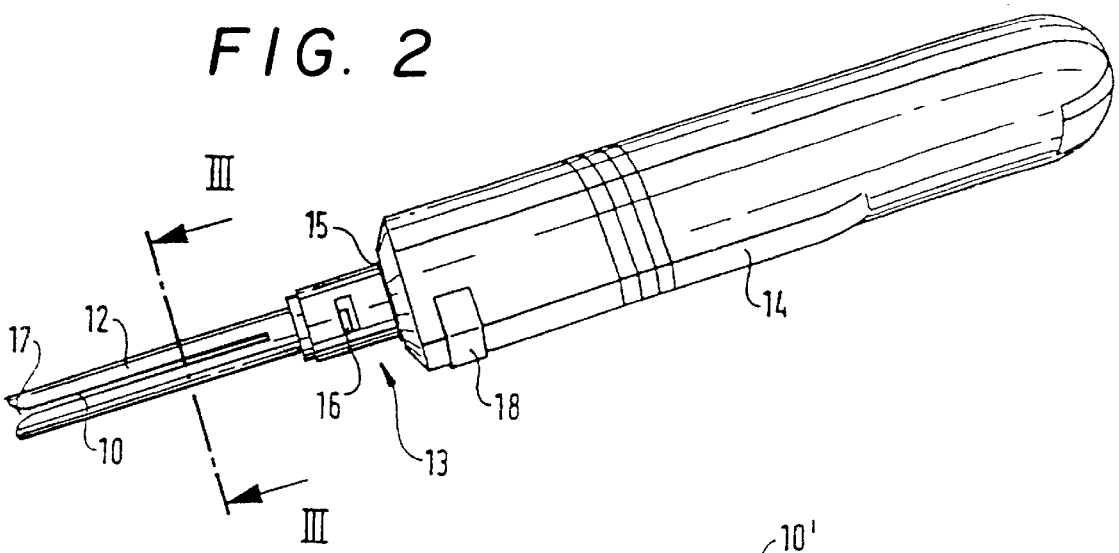
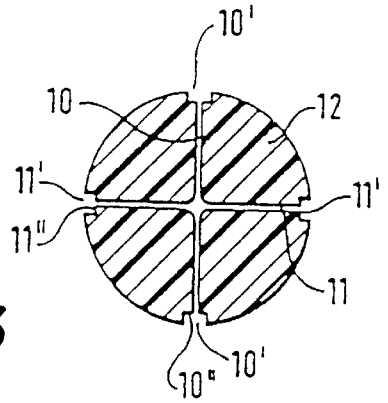
FIG. 3
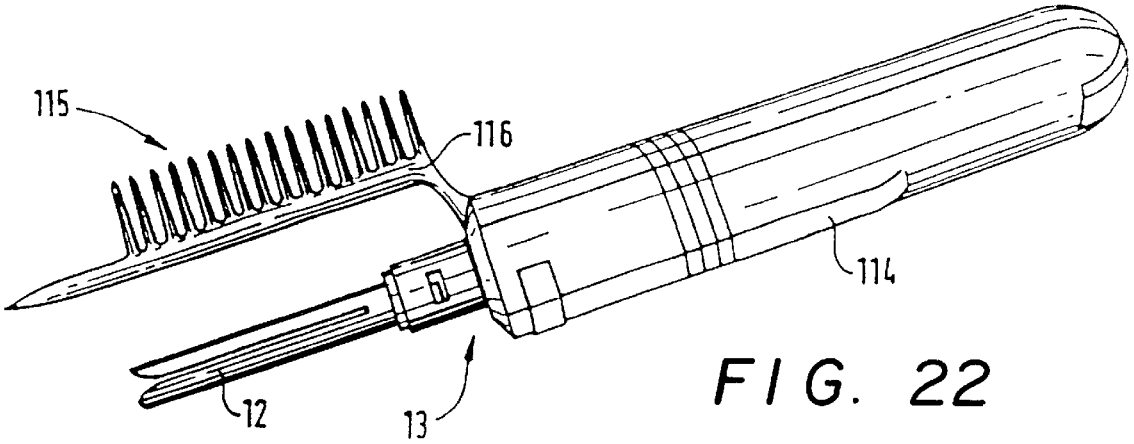
FIG. 22

HOLDING STRIP AND CURLING ROD FOR GIVING A PERMANENT WAVE

BACKGROUND OF THE INVENTION

1. Field of the Invention

The present invention relates to a method of rolling up short strands of hair in the process of giving a permanent wave, wherein the strand of hair is enclosed by a holding strip and rolled up with it, and wherein the holding strip forms the roller after curling, which is performed without hair curlers.

2. Description of the Prior Art

A method of this type is known from DE-28 26 528 U1, wherein a rectangular piece of an acid and base-resistant plastic netting is rolled up, together with a strand of hair and with the use of a curling rod, and wherein the curling rod is pulled out from the side of the rolled up hair after the hair roll is finished. This method is disadvantageous because it only works with relatively long strands of hair, and because the rolling-up process, during which the strand of hair is inserted into the curling rod between the latter and the piece of plastic netting must be held there, which requires considerable manual dexterity. It is furthermore disadvantageous that at its end away from the head the strand of hair forms a triangular tip which has the result that the hair on the side of the strand of hair has a longer way to reach the tip; this results in only loosely curled hair on both sides when rolling it up; the effect is that a tighter wave is created in the center of the hair roller and a less tight wave on the sides of the hair roller.

A method is known from DE-75 24 922 in which, for the directed wet treatment of a strand of hair with a specific hair care product, the strand of hair is protectively placed between the two folds of a soaked absorbent folded leaf and rolled onto a hair curler. This method, too, can only be used in connection with a very specific purpose and requires considerable manual dexterity when rolling up the strand of hair placed between the folded leaf. Therefore it is very time-consuming.

In a method which is known from DE-74 17 205 U2, the strand of hair is rolled up with the use of an axially slit, tube-shaped curling rod and placed into a hair clip. This hair clip is used to hold the curls in a hairdo; however, it is not used for giving a permanent wave.

A hair curler is known from U.S. Pat. No. 2,318,972 which comprises a slit rod. The use of such a hair curler in giving a permanent wave has the disadvantage that the hair is given an unsightly kink at the place were it rests against the edges of the slit. The same is true for hair curlers in accordance with U.S. Pat. No. 2,608,977.

It is known from DE 86 19 681.2 U1 to embody the hair curler in two pieces in the axial direction so that it can be flipped open, wherein a protective foil for covering the ends of the hair is applied to at least one part. Despite this, the time required in this case continues to be considerable and the disadvantages mentioned are still present.

It is known from DE 33 15 373 A1 to form curls with the aid of a clapper rod. This may make the application of permanent wave lotion easier. But the capability of shaping is limited. Rolling the strands of hair on the clapper rod is time-consuming and arduous.

A hair curler is known from DE 78 30 751 U1 which consists of a loosely rolled-up elastic large-meshed flat piece. In cross section the hair curler has the shape of a spiral, which during rolling up of the strand of hair can be strongly compressed in order to obtain different diameters of the hair roller formed in this way. The involved and extensive manipulation is disadvantageous.

A two-piece hair curler for creating particular wave shapes is known from DE 81 29 264.3 U1 which, however, also has the mentioned disadvantages.

From DE 75 31 964 U1 hair curlers are also known which are made of flat pieces, depending on the desired size, prior to rolling up. Once they have been cut to the desired size they have all the above described disadvantages of known hair curlers.

Hollow brushes with a built-in hair dryer are known from DE 31 19 085 A1, DE 35 29 267 A1 and DE 33 19 402 A1 which, however, do not offer a possibility for rolling up strands of hair for making permanent waves.

To roll up strands of hair such as takes place in giving permanent waves, normally a strand of hair is separated by means of a comb and combed forward at an angle of approximately 45° and held. A so-called "end paper" is placed around the tip of the strand of hair. Then the strand of hair is rolled on a hair curler. The position of the strand of hair on the hair curler in the rolled-up end position on the head is then fixed by means of rubber bands which are stretched from one end of the hair curler to the other. Pressure points of the rubber band on the hair are prevented by an inserted small holding rod. This is followed by soaking with permanent wave lotion for softening the hair; this is subsequently followed by fixing. Rinsing, setting, drying by means of a hair dryer or naturally and combing then follows.

Rolling up strands of hair is very time consuming and monotonous work. Although the use of end papers is intended to make the capture of the tips of the strands of hair to be rolled up by the hair curler easier, it is disadvantageous, because the triangular shape of the rolled-up strand of hair caused by this has the undesirable effect that a tighter wave is created in the center of the hair roller and a less tight wave on the sides of the hair curler. In addition, the use of the end papers means an additional monetary outlay. It therefore is not possible to roll up the strands of hair in such a way that they are being tightly held at an angle of 45° forward from the place of growth and are simultaneously rolled ribbon-like over their entire width from the direction of the head to the tip. In addition, the end papers also require a further outlay in labor because they must be laboriously removed—because they are then completely soaked through—from the strands of hair and the rollers after the permanent wave is finished.

The rubber bands used in connection with conventional hair curlers cause pressure points on the hair during the process of giving the permanent wave. It has been attempted to prevent this by means of small rods pushed between them. However, these in turn cause an undesirable, sometimes even painful pulling of the hair. The hair curlers used, which are applied in a large number per hairdo, furthermore represent an unpleasant weight on the head. The plastic material of which they are made is often very hard. This makes the giving of permanent waves into a very long and unpleasant process even today.

With respect to the quality of the shape of the permanent wave it is therefore desired to attain as wide as possible a roll-up without bringing the tips of the strands of hair together in a triangular tip, a cylindrical shape of the curler, its manufacture from a soft and light material, and finally a faster procedure.

SUMMARY OF THE INVENTION

It is an object of the present invention to provide a method, by means of which it is possible to give permanent waves even to short strands of hair, i.e. those the length of which normally is not sufficient for making a hair roll with the conventional processes.

In accordance with the present invention this object is attained in that the end of the holding strip facing the head is attached near the tip of the strand of hair as its extension.

The hair roll formed by the holding strip in the extension of the strand of hair replaces the conventional hair curler; it is soft, elastic and light. Rolling up takes place in approximately 25% less time than with conventional methods. The holding strip is used as an extension of the strand of hair. It is therefore now possible to give a permanent wave to very short hair, which up to now was completely impossible. Thus, the method of the present invention opens up completely new options for stylish short hairdos. In addition, the cumbersome manipulation and the necessity of using the known end papers can now be omitted.

An advantageous development of the method of the present invention provides that the holding strip has a flat front piece and a flat rear piece, that means that a comb-like guidance of the hair is provided between the two flat pieces, that the strands of hair are first inserted between the two flat pieces, that then the holding strip is pushed away from the head while maintaining the width of the strand of hair until the tips of the hair in the strand come to lie in the area above the upper edge of the holding strip, and that fastening of the strand of hair on the holding strip then takes place.

Pushing the holding strip up and away from the head assures that the strand of hair rests in the holding strip without triangular tapering toward the tip. This is aided by the means for the comb-like guidance provided in the holding strip. Because of this the present disadvantages of rolling up the strands of hair in a triangular shape are avoided hairdo options provided by the extension in accordance with claim.

BRIEF DESCRIPTION OF THE DRAWINGS

Exemplary embodiments of the and invention will be explained below by means of the attached drawings. Represented are:

FIG. 2, which is a view of a curling device;

FIG. 3, which is a section along the line III—III of FIG. 2;

FIG. 22, which is a modified exemplary embodiment of a curling device.

DESCRIPTION OF THE PREFERRED EMBODIMENTS

Figure 1:
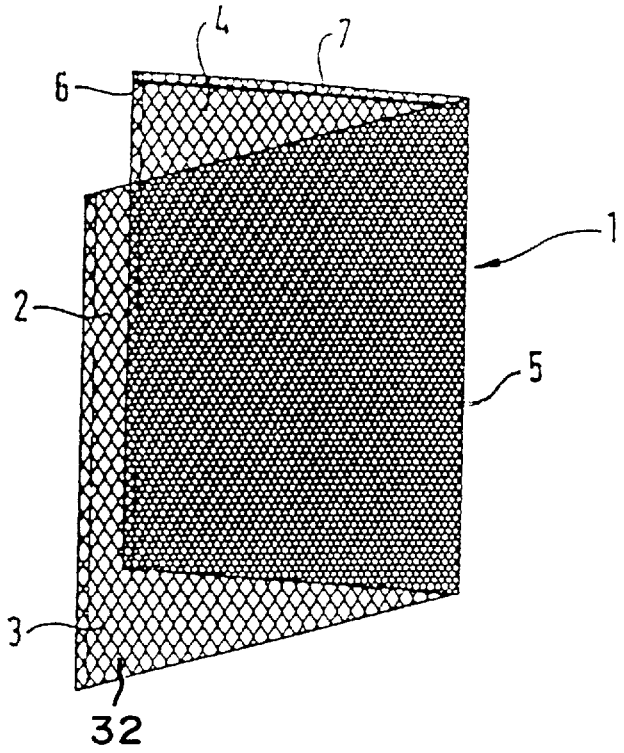
FIG. 1, which is a perspective view of a holding strip.

A holding strip 1 in accordance with FIG. 1 is used as an aid in the method. For example, it consists of gauze or netting; the material is a plastic material which is resistant to the chemicals (permanent wave and fixing liquids) used in giving permanent waves in beauty parlors. Because of the net-like structure of the flat piece of gauze or netting it is permeable to liquids, which is preferred because there are comparatively large openings 2 between the individual woven-together plastic threads, so that by means of the holding strip 1 in the rolled-up state the complete soaking and wetting of the rolled-up strand of hair by the applied liquids is possible.

The holding strip 1 is formed like a folded double leaf with a front leaf 3 and a rear leaf 4. Both transition into each other along a fold 5. The fold 5 has been treated in such a way, for example by ironing the gauze, that it remains permanently. The rear leaf 4 is provided with a stop bead 7 along its upper edge 6 which is used as stop means when introducing the holding strip into the slit 10 of the curling rod 12 of a curling device 13.

The stop bead 7 of the holding strip is oriented at right angles to the fold 5 and thus to the longitudinal direction of the holding strip 1. The dimensions of the holding strip are, for example, 4×6 cm. The range of the length can be 5 to 20 cm, and of the width 2 to 8 cm.

A further aid used with the method is the curling device 13 of FIG. 2. It has a handle 14 in which a battery (not shown) or a rechargeable battery as well as an electric motor with a step-down gear and a friction clutch are disposed. The output shaft 15 of the motor is driven at approximately 50 revolutions/second. The curling rod 12 is placed on the output shaft 15. The connection between the output shaft 15 and the motor is provided via a friction clutch, so that in the course of rolling up a strand of hair no excessive pull is exerted on it by the curling rod 12. The curling rod 12 is interchangeably disposed on the end of the output shaft 15 projecting out of the handle 14, for example by means of a bayonet closure.

As can be seen in the cross section of FIG. 3, the cylindrical curling rod 12 has two slits 10, 11, which are at right angles to each other. The radially outer ends of the slits 10, 11 open into grooves 10', 11'. During manipulation, the bottom 10" and 11" of the grooves 10', 11' is used as a receiver and a stop for the already previously mentioned stop bead 7 on the upper edge 6 of the rear leaf 4 of the holding strip 1, so that the holding strip 1 cannot slide through slit 10 or 11. In the process the stop bead 7 is completely received in the groove 10' or 11', so that pressure areas do not result from the resting against or on the hair of, for example, the stop bead 10 in the course of rolling up the hair on the curling rod.

The slits 10, 11 are furthermore provided at their front end in the axial direction with a mouth-shaped opening 17 for introducing the holding strips 1. The curling rod 12 can be selectively turned in one or the other direction of rotation by means of a double switch 18 on the handle 14.

Figure 4:
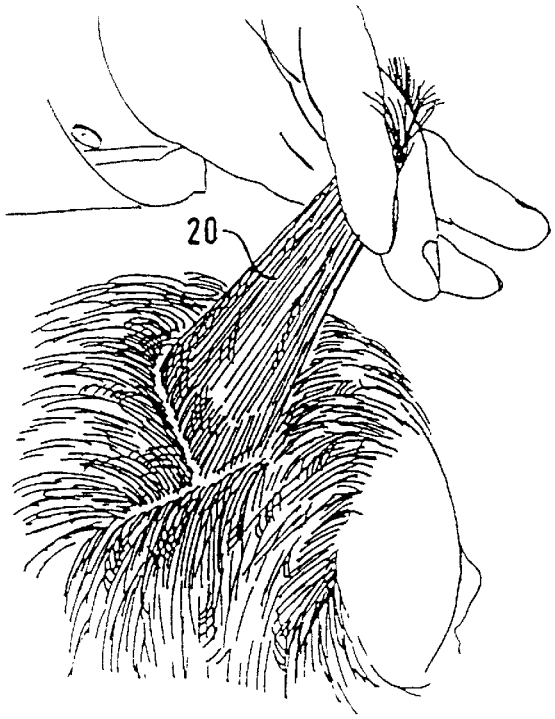
FIG. 4 to FIG. 12, which are various phases of rolling up a strand of hair.
Figure 5:
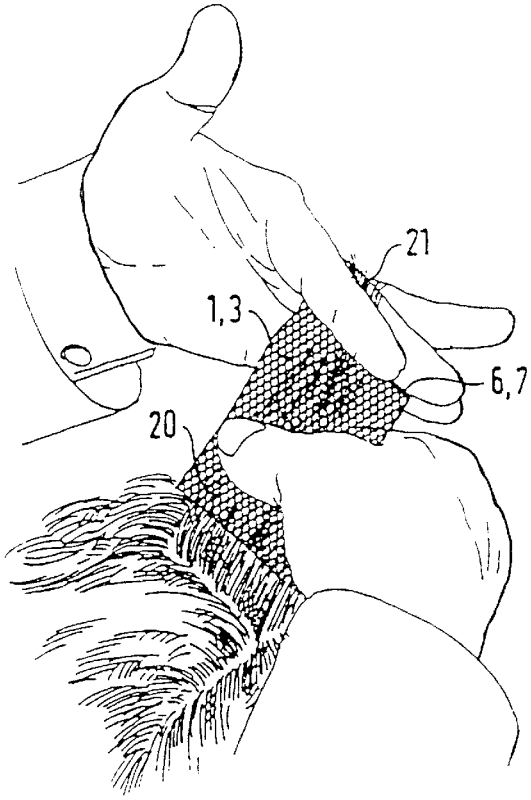
Figure 6:
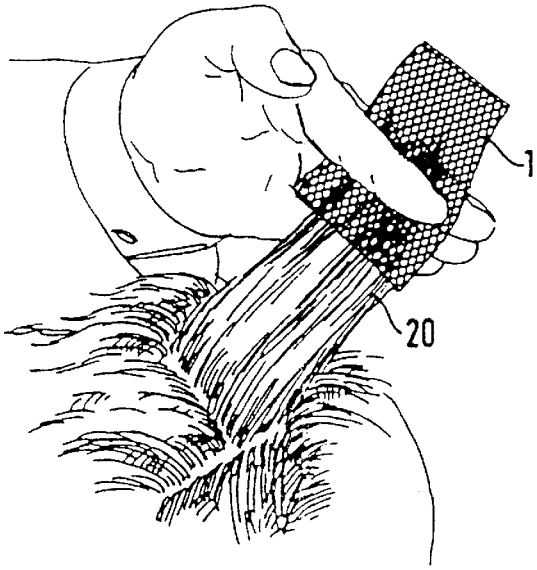
Figure 7:
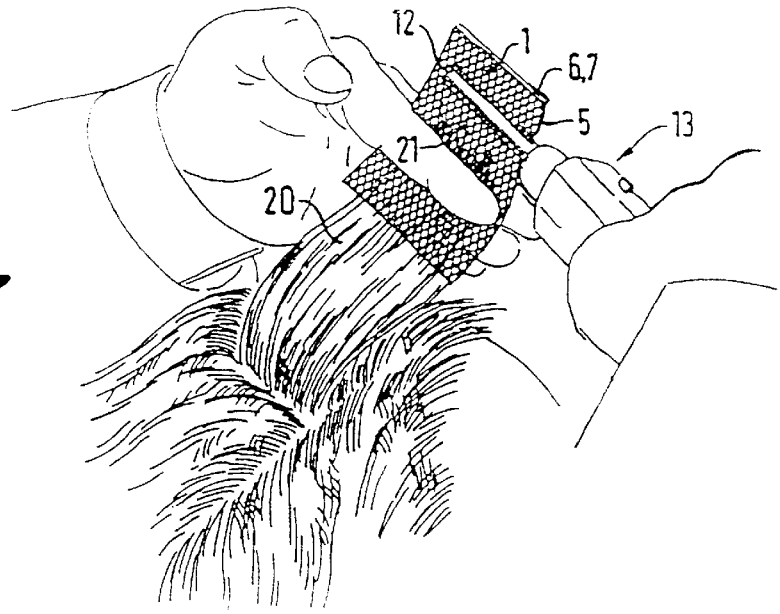
Figure 8:
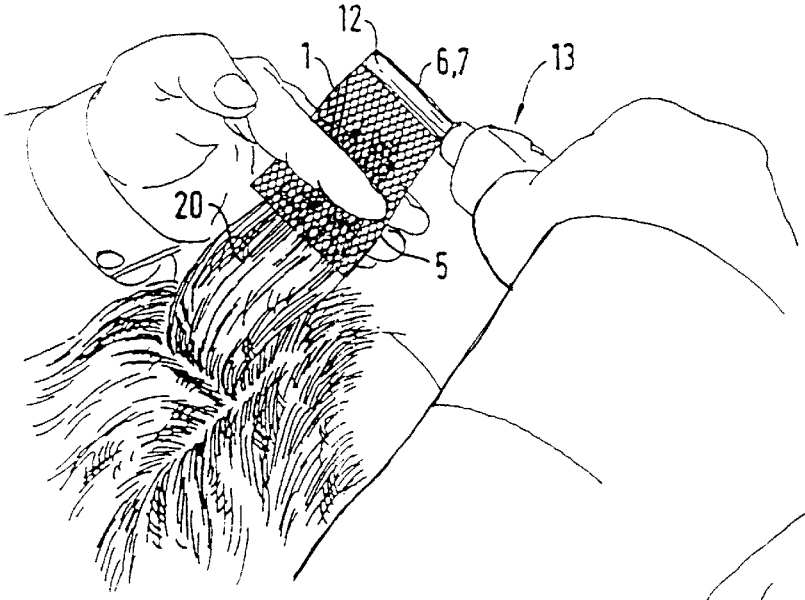
Figure 12:
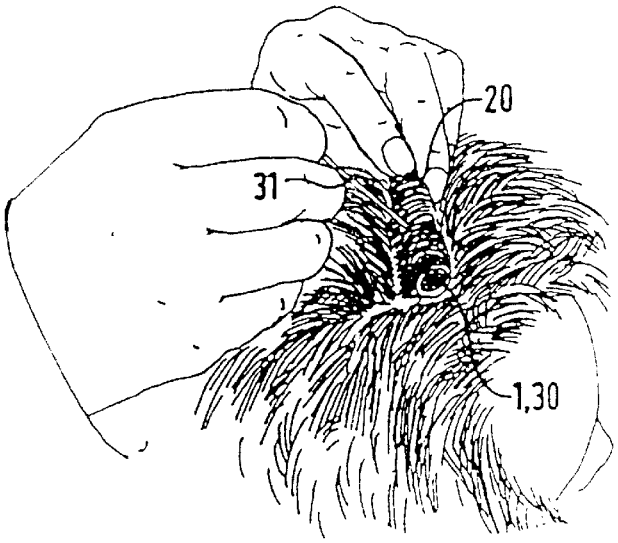

To make a hair roll, first a strand of hair 20 is separated by means of a comb from the shampooed hair—the same as in the conventional method—, which is held, for example, forward by the left hand at an angle of approximately 45°, as shown in FIG. 4. Then, as shown in FIG. 5, the holding strip 1 is placed around the strand of hair 20 with the right hand. The front leaf 3 rests on the front, the rear leaf 4 on the back on the strand of hair 20. In this case the tips 21 of the strand of hair 20 can project beyond the upper edge 6 of the holding strip 1. Then the front leaf 3 and the rear leaf 4 of the holding strip 1 are pushed together with the right hand. A parallel position of the hairs in the strand of hair 20 over the entire width of the holding strip 1 is achieved by a slight displacement of the leaves 3, 4 with respect to each other by an appropriate movement of the thumb and index finger of the right hand. Thus a triangular shape is not created as in the prior art. The full width of the strand of hair is preserved from the head to the tips of the hair. Once this state has been achieved, the holding strip 1 is pushed upward until the tips 21 of the hairs of the strand of hairs 20 terminate below the upper edge 6 by a small distance, as shown in FIG. 6. FIG. 6, therefore, shows the open state of the holding strip 1. Then the front leaf 3 is held firmly against the rear leaf 4 of the holding strip, for example with the left hand. By means of this the tips of the hairs are "fixed". As shown in FIG. 7, the curling device 13 is picked up with the right hand and one of the slits 10, 11 of the curling rod 12 is axially pushed over the holding strip 1, namely from the direction of the fold 5, until the fold 5 rests against the inner end of the slit. FIG. 12, therefore, shows a rolled-up state of the holding strip 1. Then, as shown in FIG. 8, the curling device 13 with the curling rod 12 is pushed upward until the stop bead 7 on the rear leaf 4 of the holding strip 1 is received in a groove 10' or 11' of one of the slits 10, 11 on the curling rod 12 and rests there against the bottom 10" or 11" of the groove. This assures that the upper end of the holding strip 1 cannot slide out of the slit during the subsequent manipulations; it is furthermore assured by this that the curling rod 12 is oriented exactly at right angles in relation to the longitudinal direction of the holding strip 1 and the strand of hair 20, so that subsequent slanted or skewed rolling up cannot take place. So that the holding strip 1 cannot slip through the slit 10 or 11 of the curling rod 12, the diameter of the stop bead 7 must be greater than the width of the slits 10, 11.

Figure 9:
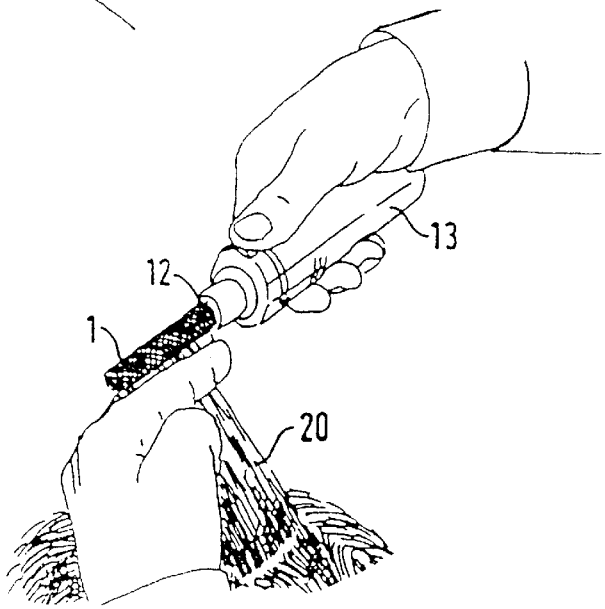

Starting with this state of affairs, the curling device 13 is then switched on which, as shown in FIG. 9, first rolls up the holding strip 1 in the area where no hairs lie between the front leaf 3 and the rear leaf 4, then the area in which the tips 21 of the strand of hair 20 lies and then finally the area of the strand of hair 20 below the holding strip.

Figure 10:
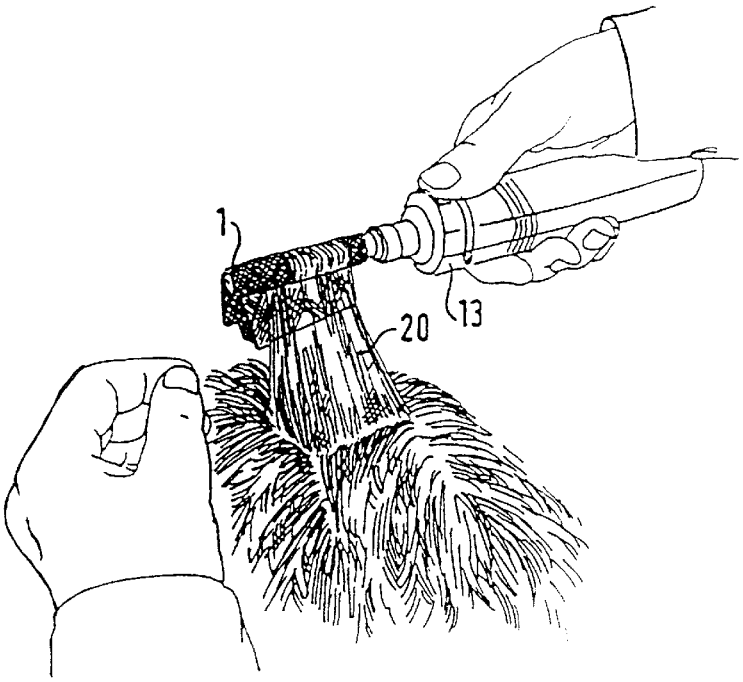
Figure 11:
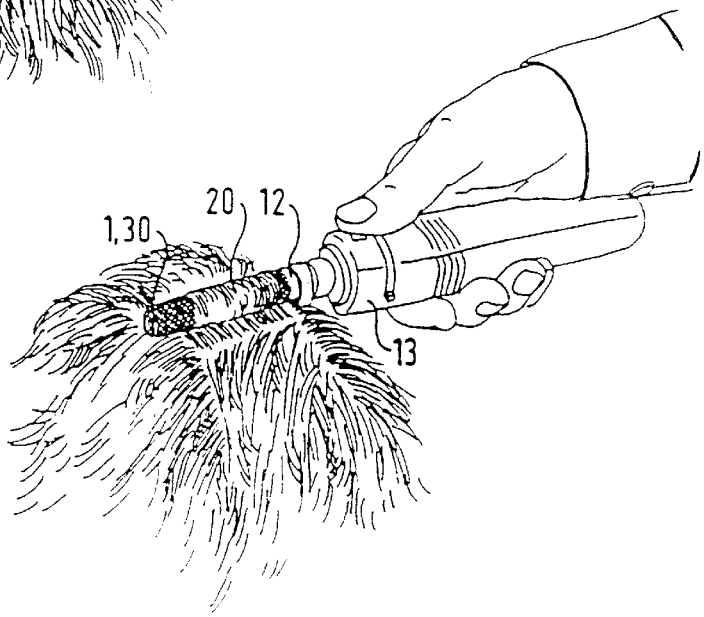

No later than at the time, when the tips 21 of the hairs of the strand of hair 20 rest against the circumference of the curling rod 12 at least once, i.e. as soon as the strand of hair has been rolled up by at least one turn, can the holding strip 1 be released, as shown in FIG. 10. Then the tips 21 of the hairs of the strand of hair 20 are clamped in the already rolled-up portion of the holding strip 1 and are held fast because of this. Once the strand of hair 20 has been completely rolled up, as shown in FIG. 11, the curling device is pulled laterally out of the hair roll 30 made in this way and formed by the rolled-up holding strip 1, which is fixed in place on the head by means of a plastic pin 31, as shown in FIG. 12, or with a clip.

A hair roll 30 has been created in this way by rolling up the holding strip 1, in or on which the strand of hair 20 is first wrapped and then rolled up.

The hair roll 30 made in this way has the advantage over customarily made hair rolls that it is not only very easy to create, but also that it is elastic and resilient so that the hair is not stretched; instead, the hair can exercise its own dynamics; this hair roll is permeable to liquids when permeable gauze is used, so that the complete wetting of the strand of hairs with the liquid to be applied is assured when giving permanent waves. The holding strip 1 can always be reused. Different hair roll diameters can be realized without great difficulty by interchangeable curling rods.

With this method care must be taken that the area of the holding strip which is rolled up before the tips 21 of the hairs of the strand of hair 20 are grasped is large enough so that no tips 21 of the hairs come to lie in a slit 10 or 11 of the curling rod 12. Otherwise the hair has an unsightly kink at this place.

At the same time the holding strip 1 represents an extension for short hair which is so short that it cannot be curled with conventional hair curlers and makes the short hair capable of being rolled up. As long as the holding strip 1 has already been rolled up by 1 to 1½ turns around the curling rod 12, it is possible to grasp and roll up strands of hair the length of which would only be sufficient for half a turn, so that they could not be rolled up on a hair curler in the customary way.

Thus, the holding strip 1 has several functions: First, it is used for grasping the strand of hair 20; second, it is used for making the hair roll 30; third, it is used to extend the strand of hair 20 and thus for improved roll-up capability; only by means of this last-mentioned capability is an opportunity for rolling up short hair provided. It is thus possible to give a permanent wave to short hair in such a way that it transitions at an angle of 40° to 60° away from the head into a half or ¾ wave, the outer ends of which are combed parallel with the head. In this way novel stylish options in the creation of short hair styles are created by the method.

An advantageous modification of the holding strip can be such that small pin- or knob-shaped projections 35 of an approximate length of 2 mm are provided in the lower fourth or third of the inward facing surface of the front leaf 3 of the holding strip 1, which pass through the openings 2 in the rear leaf 4, such as are formed by the gauze of the back, when the holding strip 1 (such as the one in FIG. 5) with the inserted strand of hair 20 is pressed together, so that by means of this a mutual holding and fixing of the front leaf on the rear one of the holding strip takes place at least complementary to the manual grasp; at the same time this creates a comb-like guidance of the hairs of the strand of hair 20 when the holding strip 1 is pushed up from the position in accordance with FIG. 5 into the position in accordance with FIG. 6.

Figure 13:
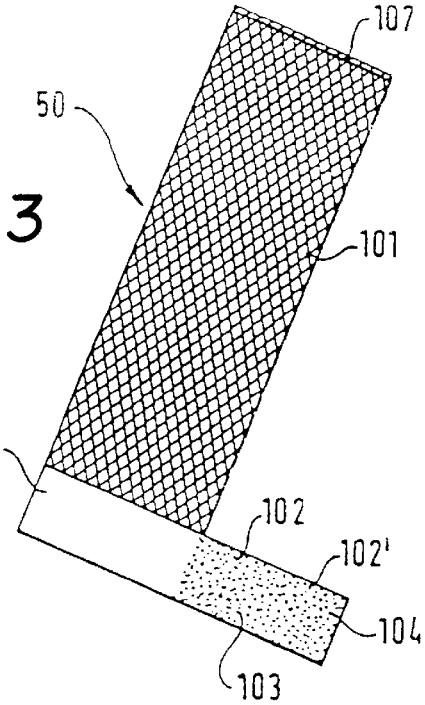
FIG. 13, which is a second exemplary embodiment of a holding strip.
Figure 14:
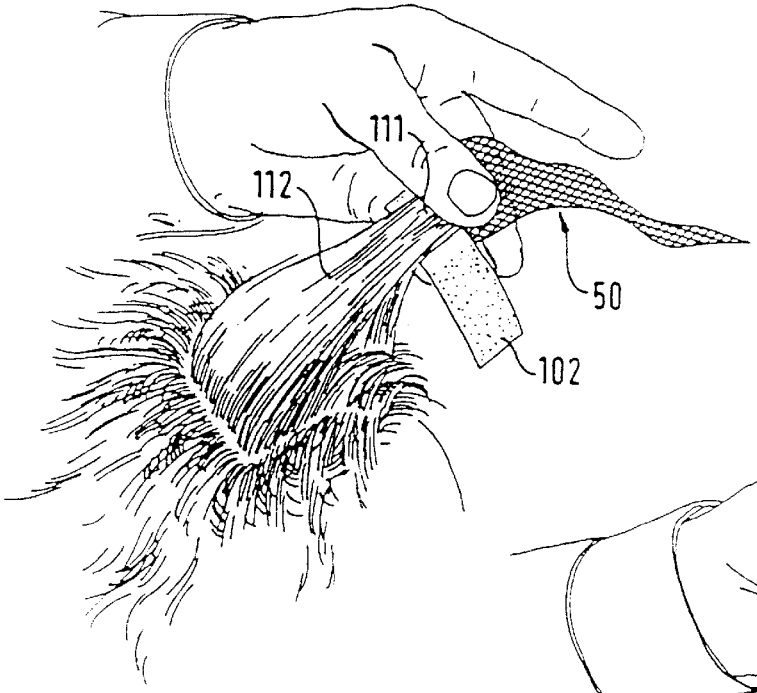
FIGS. 14 to 16, which are various phases of rolling up a strand of hair, using the holding strip of FIG. 13.
Figure 15:
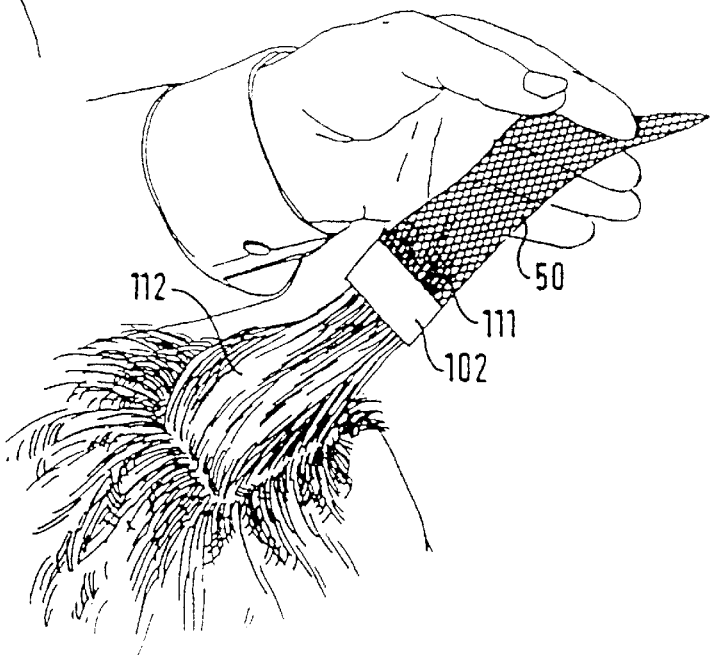
Figure 16:
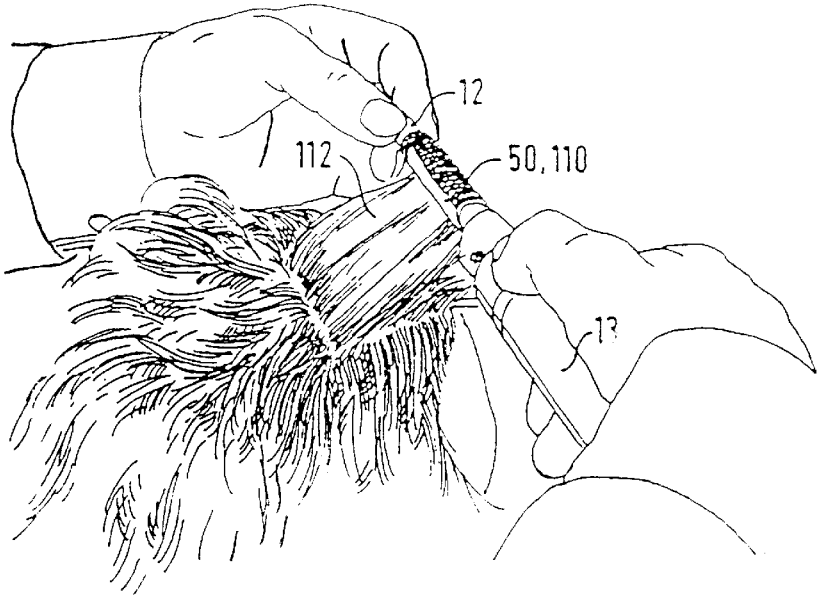

Another modification of the adhesive strip is shown in FIG. 13. The holding strip 50 is particularly well suited for rolling up very short hair. It is formed by a flat and, compared with the exemplary embodiment of FIG. 1, long and narrow strip 101, preferably also of gauze, to the lower edge of which an adhesive strip 102 has been transversely glued. This projects past the right lower edge so far that the length of the projecting part 102' is equal to the width of the plastic strip 101. The side 103, which in the drawing plane faces the viewer, is provided with an adhesive layer 104 (indicated by stippling). The back is non-adhesive. The holding strip 50 is provided with a stop bead 107 on its upper end. To create a hair roll 110, first the tips 111 of the strand of hair 112 are placed on the lower area of the holding strip 50, as shown in FIG. 14; then the right, projecting part 102' of the adhesive strip 102 is folded over and pressed on the tips 111 of the hair. Thus, the tips 111 of the hairs of the strand of hair 112 are held by the adhesive layer 104 between the plastic strip 101 and the adhesive strip 102. Then a slit 10 or 11 of the curling rod 12 of the curling device 13 is pushed on the adhesive strip 50, placed against the top and rolled up, as shown in FIG. 16. The hair roll 110 is created in this way.

A thin foil can also be used as the strip 101. If then the strip 101 is made a little longer the result is that the hair roll created by rolling up the strip is still sufficiently stable. With short hair, and in some cases also with long hair, there is no harm if the permeability of the strip 101, as is provided in a holding strip of gauze in accordance with FIG. 1, is omitted, since the tips of the hairs are then the ones which are not touched by the permanent wave lotion. This could be desirable, because then the areas of the hair immediately adjacent to the skin of the head are given a permanent wave but the tips, which were already included in previous permanent waves, are not.

Figure 17:
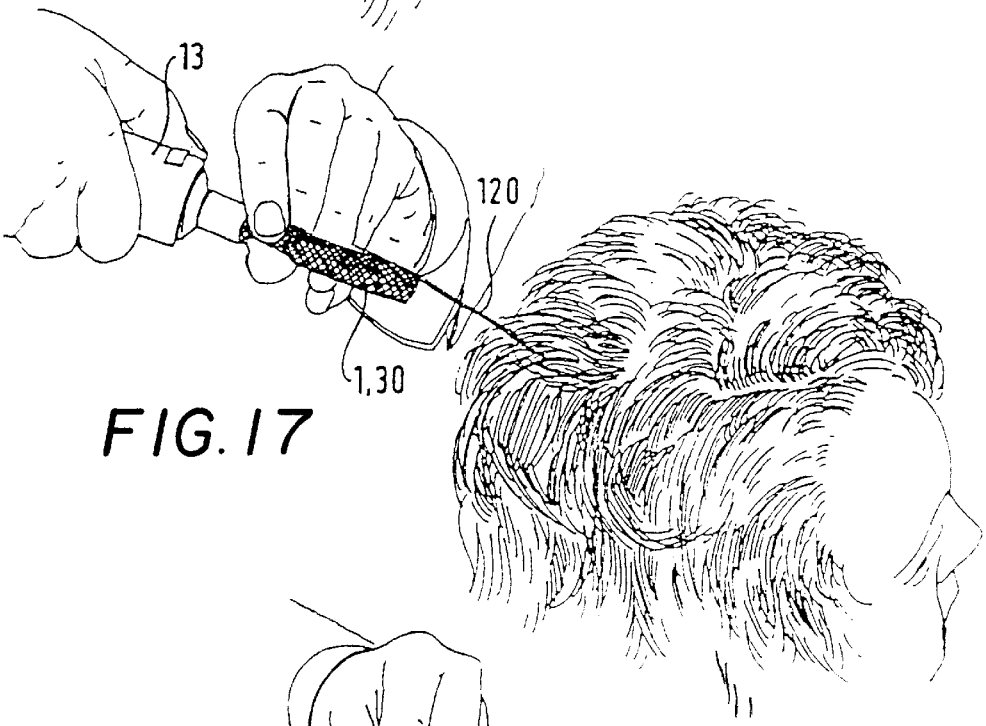
FIGS. 17 and 18, which show making a helical wave.
Figure 18:
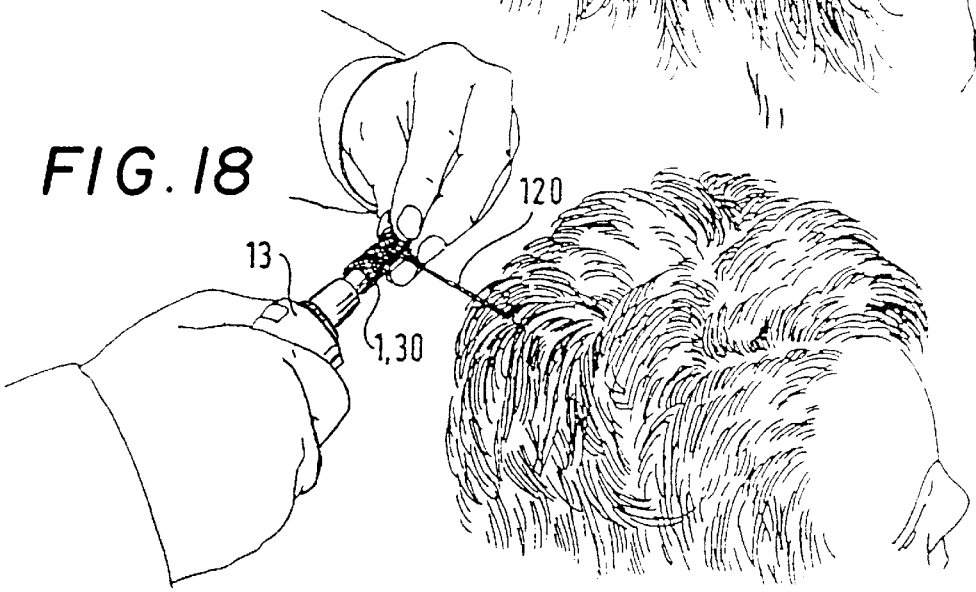

It is also possible to create so-called "helical waves" by means of the described method. This means the rolling up of very long hair on curlers. First, the tips of a strand of hair are rolled up in about the way shown in FIGS. 9 and 10. Then the curling device 13 is rotated with respect to the strand of hair 120 in such a way that—as shown in FIG. 17—the axial direction of the curling rod 12 is essentially aligned with the strand of hair 12, which is kept slightly tensed. If the curling device 13 is further turned, the strand of hair 120 is twisted in itself to form a rope. Then this rope is wound helically on the curling rod 12, as shown in FIG. 18.

Figure 19:
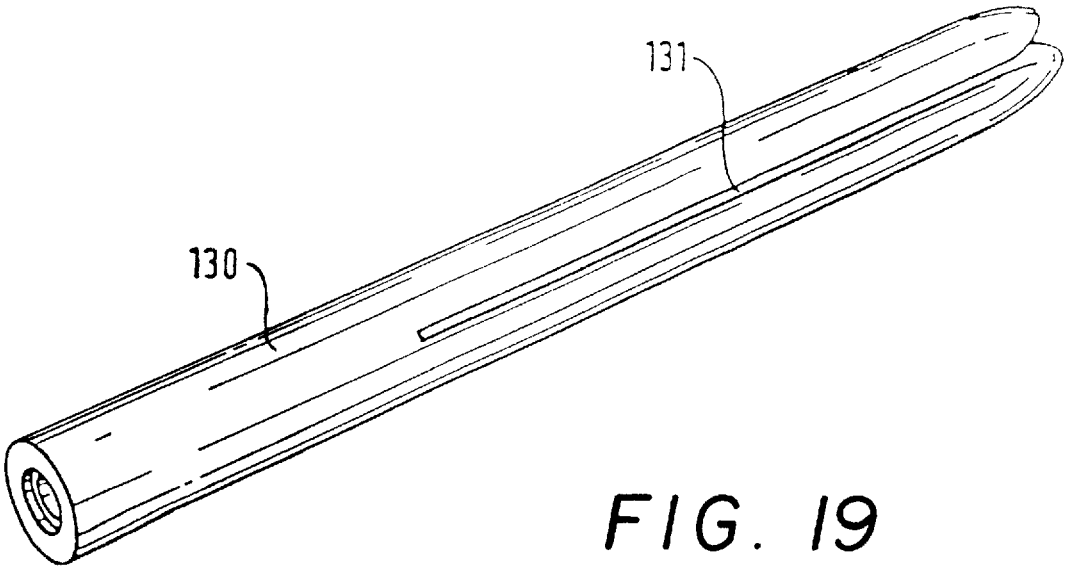
FIG. 19, which is a curling rod.

Rolling a hair roll 30 does not necessarily have to be done with a motor-driven curling device 13. In some cases, for example for home use, a simple, manually turned curling rod 130 with a slit 131, such as illustrated in FIG. 19, is sufficient. The curling rod is pulled out after rolling up. Thus it is not a curler or a roller in itself, but only an aid for the rolling-up process. A number of such curling rods 130 sufficient for a hairdo, about four with different diameters, with approximately 50 holding strips 1 or 50 can be combined in a sales package.

Figure 20:
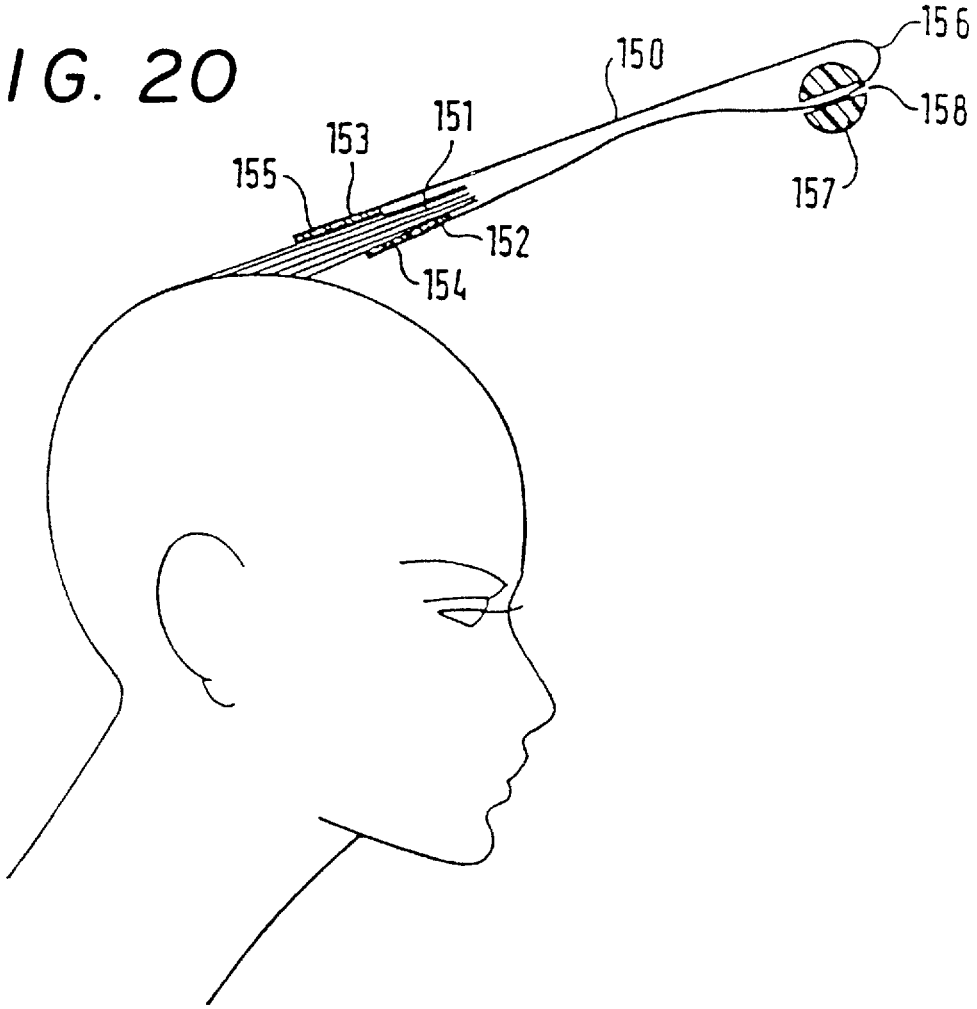
FIG. 20, which is a schematic representation of a further exemplary embodiment of a holding strip.

FIG. 20 shows a further development of a holding strip. The holding strip 150 is sufficiently long that its two ends 152, 153, which are provided with an adhesive layer 154 or 155, are placed on the strand of hair 151 from the one or the other side. The holding strip 150 forms a loop 156 between the ends 152 and 153 which now can be used—without a stop bead now being required—as a stop, that is to prevent its sliding out, and as placement aid for a curling rod 157, which is provided with the slit 158 and is inserted into the loop 156 in the manner shown.

Figure 21:
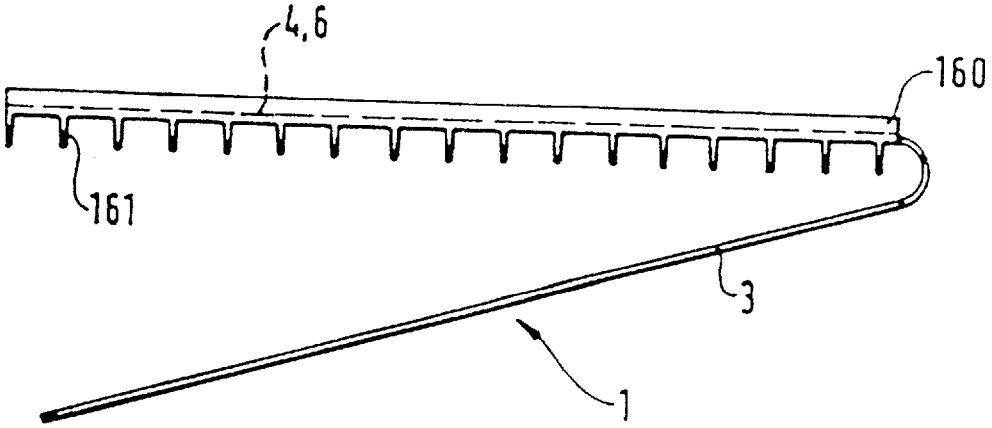
FIG. 21, which is a further embodiment of a stop bead on the holding strip.

FIG. 21 shows a modification of the stop bead, such as is provided on a holding strip in accordance with FIG. 1, for example, in a top view, so that the upper edge 6 of the holding strip 1 appears only in dashed lines, i.e. embedded into the stop bead 160. The most important thing here is that in this case the inside of the back part 4 is embodied in the shape of a comb by means of several teeth 161 disposed at a distance from each other. Thus if, as shown in FIG. 5, the strand of hair is first placed between the front part 3 and the rear part 4 of the holding strip 1, the upper tips of the hairs of the strand of hair come to rest between the teeth 161. If then, as shown by moving from FIG. 5 to FIG. 6, the holding strip 1 is moved upward, the teeth 161 in the comb-shaped guide act in such a way that the strand of hair is maintained or distributed over the entire width, so that the described disadvantages of the formation of a triangular tip (as in the prior art) are prevented here even better and directedly in a special way.

FIG. 22 shows a modification of the curling device 13 of FIG. 2. In this case a right-angled foot part 116 of a styling comb 114 is formed on a handle 114 in such a way, that it extends parallel with the curling rod 12 at a distance of 1 to 3 cm. In this way the hairdresser no longer needs to put the device down. A strand of hair is separated with the styling comb (FIG. 4). Then the holding strip is pushed over the strand of hair 20 (FIGS. 5, 6). In the process the hairdresser keeps the curling device with the styling comb in his hand, the same way as he always keeps the styling comb in his hand during the present curling technique when grasping the "end" paper and when rolling up the strands of hair on a curler. Then the holding strip is rolled up by means of the curling device (FIGS. 7 to 11). The process is then repeated. The constant need to put the comb away is then omitted. Work proceeds flowingly. It should be kept in mind in this connection that the curling device can be very light, since it needs to provide only a small output and after the hairdo has been completed, it can be placed into a holder, in which the chargeable battery of the curling device is connected with a charging device.

I claim:

1. A reusable holding strip serving as an elongated roller for rolling up strands of hair in the process of giving a permanent wave to a person, the strands of hair defining hair tips, comprising:

a flat element for receiving a strand of hair, said flat element including a front leaf, a rear leaf, a fold edge which connects the two leafs, and a plurality of through-openings formed in at least one of said front leaf and said rear leaf for the passage of liquid, said flat element defining a flat state wherein said front leaf, said rear leaf and said fold edge are substantially coplanar, and a rolled-up state wherein said front leaf, said rear leaf and said fold edge form an elongated hollow roller, said front leaf and said rear leaf defining means for fixing the tips of the strand of hair on said flat element when said flat element is in said flat state; and stop means fixed on said flat element and located at the end of at least one of said leafs of said flat element and adapted to rest against the bottom of a groove at the end of a slit of a curling rod used to roll up the strand of hair onto said flat element, wherein said flat element is adapted for repeated transition between said open state and said rolled-up state with access during the rolled-up state to liquid for the received strand of hair.

2. The holding strip as defined in claim 1, wherein said leafs have a width of 2 to 8 cm and a length of 5 to 20 cm.

3. The holding strip as defined in claim 1, wherein said means for fixing the tips of the strand of hair on said flat element further includes an adhesive strip which is applied transversely to the strand of hair, said adhesive strip has an adhesive layer which can be brought to rest against said holding strip.

4.The holding strip as defined in claim 1, wherein said flat element is provided with two ends each having an adhesive layer forming said means for fixing, said adhesive layers being situated so that they are fastened on opposite sides of the strand of hair, and wherein said stop means comprises a loop formed by said flat element for receiving a curling rod.

5. The holding strip as defined in claim 1, wherein said stop means defines a stop bead embodied in the shape of a comb.

6. The holding strip as defined in claim 1, wherein said flat element defines a longitudinal direction, and wherein said stop means is oriented at right angles relative to the longitudinal direction of said flat element so that subsequent skewed rolling up of the holding strip and the strand of hair is prevented.

7. The holding strip as defined in claim 1, wherein said flat element is embodied as net-like.

8. The holding strip as defined in claim 1, wherein said flat element is made of plastic material which is resistant to permanent wave or fixing liquid.

9. The holding strip as defined in claim 1, wherein one of said leafs includes projections on the inwardly facing surface of said leaf, said projections providing guidance means for said strands of hair, and wherein said openings in the other of said leafs receive said projections when both leafs are pressed together to hold said strands of hair.

10. A curling rod for use with a holding strip for rolling up strands of hair on the holding strip in the process of giving a permanent wave to a person, said curling rod being embodied to be cylindrical and having at least one continuous slit along its longitudinal direction, said slit being provided with a funnel-shaped slide-on opening at one outer end, wherein said slit includes two radially outer open ends with at least one open end being provided with a groove extending radially inwardly from the outer surface of said cylindrical curling rod to a bottom surface adapted to receive stop means provided on a holding strip, when said holding strip is passed through said slit, and wherein the stop means, when received in said groove, has its outer surface substantially coincident with the outer surface of said cylindrical curling rod.

11. A curling deice comprising:

a handle housing motor means having a drive shaft;

a curling rod disposed on the drive shaft for rotation relative to said handle, said curling rod including at least one slit defining a groove; and a holding strip for placement about a strand of hair, such that it forms an extension of the strand of hair, and engageable with said curling rod to roll up the strand of hair in engagement therewith when said curling rod is rotated by the drive shaft, said holding strip having stop means which rests against the bottom of a groove of said at least one slit, said holding strip comprising:

a flat element for receiving a strand of hair, said flat element including a front leaf, a rear leaf, a fold edge which connects the two leafs, and a plurality of through-openings formed in at least one of said front leaf and said rear leaf for the passage of liquid, said flat element defining a flat state wherein said front leaf, said rear leaf and said fold edge are substantially coplanar, and a rolled-up state wherein said front leaf, said rear leaf and said fold edge form an elongated hollow roller, said front leaf and said rear leaf defining means for fixing the tips of the strand of hair on said flat element when said flat element is in said flat state; and stop means fixed on said flat element and located at the end of at least one of said leafs of said flat element and adapted to rest against the bottom of a groove at the end of at least one slit of the curling rod used to roll up the strand of hair onto said flat element, wherein said flat element is adapted for repeated transition between said open state and said rolled-up state with access during the rolled-up state to liquid for the received strand of hair.

12. The curling device as defined in claim 11, wherein said curling rod is interchangeably disposed on the drive shaft.

13. The curling device as defined in claim 11, further comprising:

a right-angled foot element attached to said handle; and a styling comb extending from said right-angled foot element such that it extends for 2 to 3 cm parallel with said curling rod.

* * * * *